US005168915A

United States Patent [19]

Lafleur

[11] Patent Number: 5,168,915

[45] Date of Patent: Dec. 8, 1992

[54] GARAGE DOOR

[76] Inventor: Jean C. Lafleur, 3409 Maricourt Street, Apt. 6, Sainte-Foy, Canada, G1W 2M4

[21] Appl. No.: 764,208

[22] Filed: Sep. 23, 1991

[51] Int. Cl.[5] ..... E06B 3/12

[52] U.S. Cl. ..... 160/236; 160/201

[58] Field of Search ..... 160/236, 201, 133; 52/476, 477, 656

[56] References Cited

U.S. PATENT DOCUMENTS

| | | | |
|---|---|---|---|
| 3,899,858 | 8/1975 | Zanker | 52/172 |
| 4,008,745 | 2/1977 | Bailey | 160/201 X |
| 4,119,133 | 10/1978 | Wolf | 160/201 X |
| 4,164,830 | 8/1979 | Bierlich . | |
| 4,640,078 | 2/1987 | Haffer . | |
| 4,643,239 | 2/1987 | Wentzel | 160/201 |
| 4,802,319 | 2/1989 | Lafleur | 52/656 X |
| 4,854,365 | 8/1989 | Juneau | 160/236 X |
| 5,002,114 | 3/1991 | Hormann | 160/201 X |

*Primary Examiner*—Blair M. Johnson

*Attorney, Agent, or Firm*—Pierre Lespérance; Francois Martineau

[57] ABSTRACT

Each panel of a garage door of the articulated type comprises a rigid metallic, rectangular frame including a pair of horizontal longer members and a pair of vertical shorter members rigidly interconnected. A casing surrounds the longer members and is made of two extruded sections, of synthetic material, which protrude laterally from the metallic frame and are interconnected to each other. The outer casing section carries weather strips for sealingly engaging the outer section of an adjacent panel. The outer casing section also carries retaining strips of J-shaped cross-section, which retain sheathing panes forming the main panel faces. These sheathing panes may be translucent or transparent, or may be opaque to conceal heat-insulating material which fills the panel inner space. Spaced upright mullions are disposed within the door panel and fixed to the horizontal frame members to provide anchors for the hinges which interconnect the panels.

14 Claims, 6 Drawing Sheets

GARAGE DOOR

FIELD OF THE INVENTION

This invention relates to articulated garage doors and, more particularly, to the construction of the constituting panels of the same.

BACKGROUND OF THE INVENTION

Garage doors are usually made of a number of rectangular panels hingedly connected in successive pairs. The door panels are supported and guided by rails, each having a horizontal section anchored to the ceiling of the garage. When the door is closed, all the panels are vertical; when the door is being opened, the successive panels are pulled upwardly along the rails and pivoted through 90 degrees from a vertical to a horizontal position about their interconnecting hinges. Therefore, the panels must be sufficiently strong to avoid bending, when in horizontal position. Also, the panels must have efficient weather-proofing and good thermal insulation for use in cold climates. In applicant's own prior U.S. Pat. No. 4,802,319, dated Feb. 7, 1989, and entitled: PANEL STRUCTURE FOR GARAGE DOORS AND THE LIKE, a panel structure is described, which is designed to overcome the above-noted problems. However, it has been found in practice that the assembly of the rigid metallic frame, with the overlying casing made of synthetic resin, is rather cumbersome and time-consuming since the legs of the cross-sectionally U-shaped casing have to be spread apart for the insertion of the metallic frame, since this casing, which is made of extruded sections, has to be cut at 45 degrees to fit at the corners of the panels, since there is no provision for the easy addition of sealing strips for weather-proofing the junctions of adjacent panels; and since the plastic casing has to be cut out at the hinges, in order to directly secure said hinges to the door panel.

OBJECTS OF THE INVENTION

It is therefore the general object of the present invention to provide a garage door panel structure which overcomes the above-noted disadvantages.

Another object of the present invention is to provide a garage door panel structure in which worn or broken weather strips and sheathing panes can be easily replaced.

Another object of the invention is to provide a garage door panel structure in which the sheathing panes are retained by retainer flanges, which cannot be removed when the door is closed.

Another object of the invention is to provide such a structure having easily-installed mullions for reinforcing the panel structure and also for serving as anchoring members for the hinges.

SUMMARY OF THE INVENTION

The garage door panel in accordance with the invention comprises a rectangular reinforcing frame including a pair of horizontal longer members and a pair of vertical shorter members rigidly interconnected and a casing surrounding the longer members and formed of an inner casing section overlying the inner face of the longer member and protruding from the side faces of the latter; and an outer casing section overlying the outer face of the longer member and protruding from the side faces thereof. Interconnector means interconnect the inner and outer casing sections on each side of the longer frame members. The outer casing section defines opposite abutment faces parallel to and laterally, outwardly spaced from the side faces of the longer member. Sheathing panes are applied against said abutment faces and retainer strips overlie said panes, surround the edges of the latter and are secured to the outer casing section. Said retainer strips retain the panes against the abutment faces. Seals are carried by the outer casing section for contacting an adjacent garage door panel. The panes can be translucent or transparent, at least in part. Alternately, the panes can be opaque to conceal insulating material filling the space defined between the inner frame sections and the vertical shorter frame members. Preferably, each seal consists of an extruded strip of flexible material, having a cross-sectionally tubular body joined to a T-shaped anchoring root. The anchoring root is inserted through a slit of a longitudinal cavity made in the outer casing section, whereby the strip can be inserted or removed by pulling on the same longitudinally of the outer frame section. Preferably, mullions vertically extend between the horizontal longer members at spaced locations along the panel. Each mullion abuts against the inside face of the sheathing panes and serves as screw anchors for door panel hinges screwed to said mullions through said sheathing panes. Preferably, each mullion has end notches receiving the horizontal longer members and the mullions terminate short of the outer frame sections, so that the latter are not obstructed and can extend over the entire longer members and overlie the ends of the mullions. The inner casing sections are simply interrupted at the junction of the mullions with the horizontal longer members. The inner and outer casing sections and the retainer flanges are assembled by snap connector members and can be released from each other by relative longitudinal movement along the extrusions. Preferably, the inner frame sections are shaped to retain dessicant containing perforated tubes in communication with the hollow space within the garage door panel, said tubes being used when the sheathing panes are transparent or translucid.

DETAILED DESCRIPTION OF THE INVENTION

The garage door 10 is of the articulated multiple panel type, being constituted by a number of rectangular panels 12 which are pivotally connected in pairs by means of end hinges 14 and intermediate hinges 14'. The end hinges 14 are provided in conventional manner with rollers 15 adapted to engage and be guided in rails, not shown. The rollers 15 are pivoted at the junction of the two hinge leaves 14*a* anchored to adjacent panels 12. The panels can move between a closed vertical position and a fully opened horizontal position. In cold climates, weather strips project from the vertical portions of the rails to overlap the ends of the panels when the door is in closed position and make a weather-proof joint.

Figure 4:
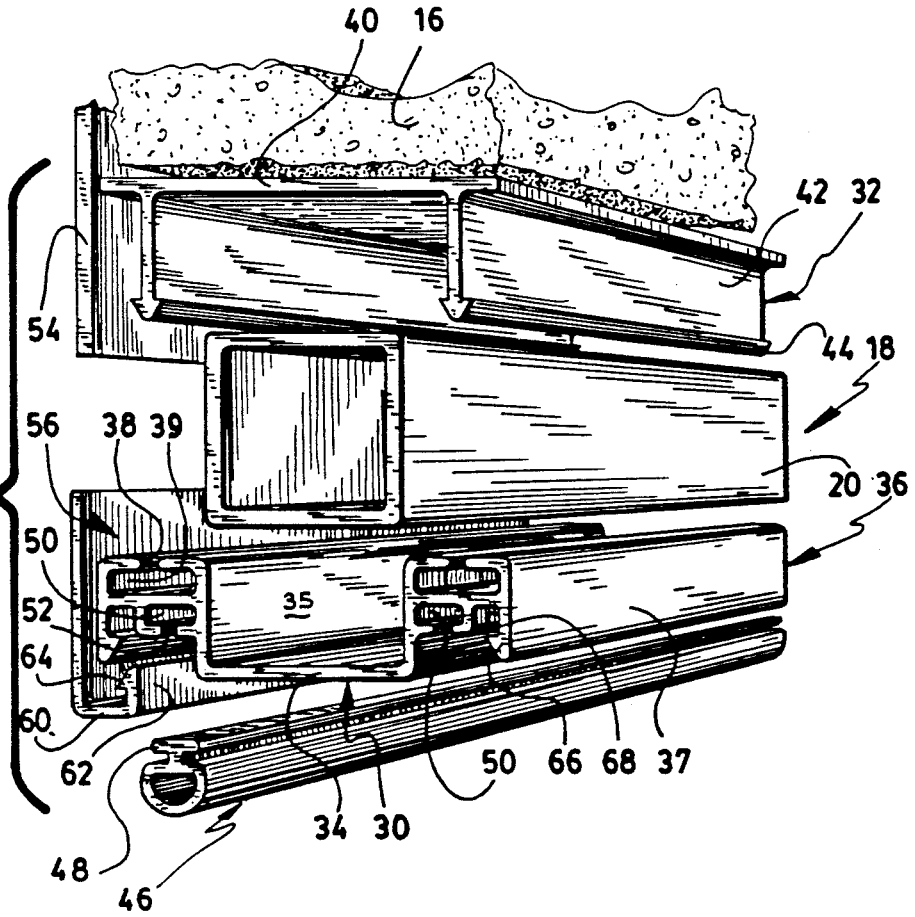
FIG. 4 is an exploded partial perspective view at an enlarged scale of one of the door panels of FIGS. 2 and 3.
Figure 6:
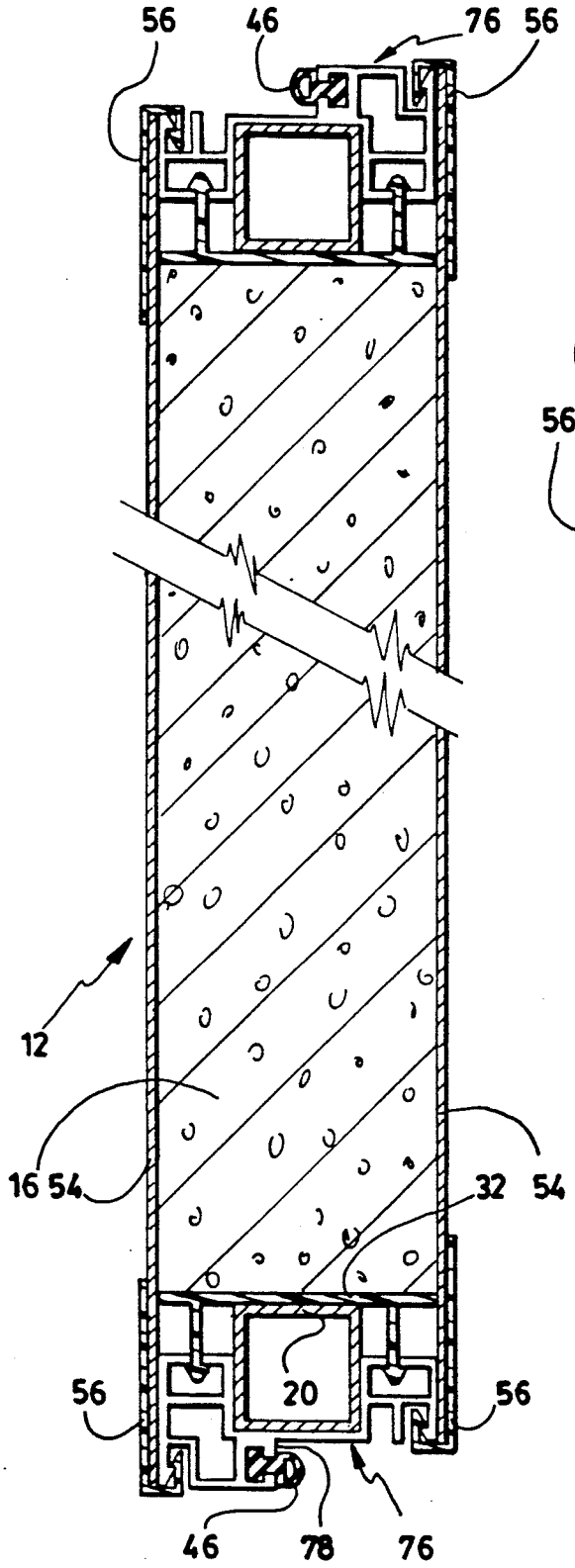
FIG. 6 is a cross-section of a third embodiment of the door panel.

Each panel 12 comprises boards of insulating material, shown at 16 in FIGS. 4 and 6, preferably a synthetic foam. These boards are surrounded by a narrower, reinforcing steel frame 18, made of tubular members. The frame member 18 is formed of a pair of horizontal longer frame members 20 and a pair of shorter vertical frame members 22, which are welded together to form an elongated rectangular frame.

Posts, or mullions 24, vertically extend between the longer frame members 20 at spaced intervals longitudinally of the panel 12 including end mullions 24*a* which are similar to the intermediate mullions 24. The mullions are preferably made of wood, but can be made of steel and welded to rigid frame 18. As shown in FIGS. 12 to 15, the shorter frame members 22 are secured to the longer frame members 20 short of the outer ends portions 26 of the latter, and the end mullions 24*a* are disposed on the outside of the vertical frame members 22. Each mullion 24, 24*a* is of a thickness substantially equal to that of the insulating boards 16 and are provided at their ends with a notch 25, in which the horizontal longer frame member is partially inserted, as clearly shown in FIG. 13. The mullions 24, 24*a* can be thus maintained in position by a friction-fit or, alternately, they could be screwed to the frame 18. Obviously, the boards 16 are separated by the intermediate mullions 24. The intermediate mullions 24 serve as anchoring members for the intermediate hinges 14' (FIG. 3) interconnecting the adjacent panels intermediate the ends of said panels. The outer mullions 24*a* serve to anchor the hinge leaves 14*a* of the hinges 14 provided with the rollers 15.

A casing 28, made of synthetic resin, surrounds only the longer frame members 20 and not the vertical shorter members 22. Casing 28 is formed of two sections, namely: an outer casing section 30 and an inner casing section 32. Both sections are extrusions and, therefore, have a uniform cross-section throughout their length.

Figure 2:
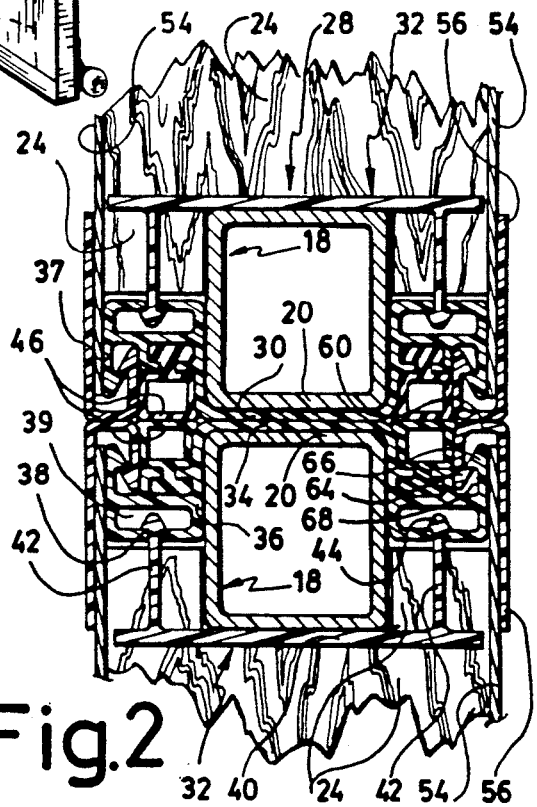
FIGS. 2 and 3 are enlarged, cross-sectional partial views taken along lines 2—2 and 3—3 of FIG. 1, showing a first embodiment of the door panel according to the invention.
Figure 3:
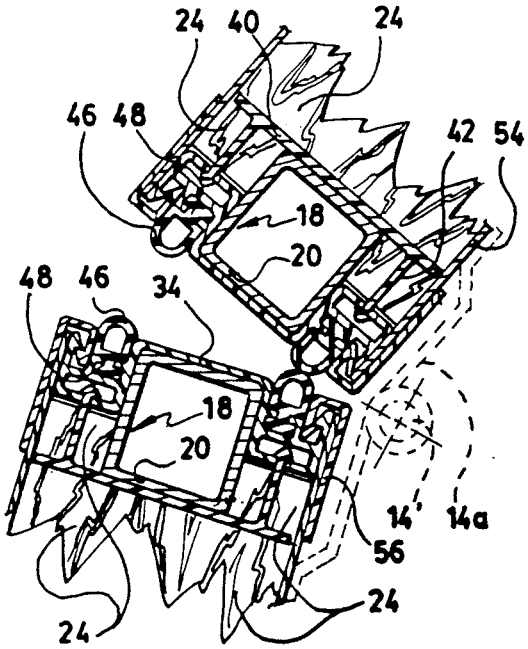

Referring to FIGS. 2, 3, and 4, the outer casing section 30 is designed to overlie the outer face of the longer frame member 20 by means of a central web 34 and by its lateral inwardly recessed portions 36 partially covering each side face of the member 20. The inner face of each recessed portion 36 has a connector slit 38, which longitudinally extends and opens in a cavity 39. The inner casing section 32 includes a flat base 40 adapted to overlie the inner face of the frame member 20 and to extend on each side thereof. A pair of outwardly-extending flanges 42 are connected to the base 40 and are terminated by arrow-shaped ribs 44 which are snapped into retaining position within the slits 38. Weather strips, or seals 46, make a weather-proof joint between adjacent panels.

In the embodiment of FIGS. 2 to 5, there are provided two longitudinally-extending seals located in the two lateral portions 36. Each seal 46 has a tubular body joined to a T-shaped anchoring root 48, the cross-leg of which is inserted into a seal-retaining cavity 50 through a slit 52', cavity 50 and slit 52 being disposed at the bottom of the recessed portion 36 and facing outwardly of the panel.

The inner and outside faces of each panel 12 is covered by a sheathing pane 54 retained in position by pane-retaining strips 56. Each sheathing pane 54 is applied directly against the main faces of the insulating boards 16 and on the side faces of the mullions 24 and 24*a* and abut against the abutment walls 37 formed by the lateral portions 36 of the outer casing section 30. Each retaining strip 56 is of J-shaped cross-section and overlaps the marginal portion of the sheathing pane 54 along the top and bottom edges thereof. Strip 56 has an outer transverse section 60 which overlies the edge of the sheathing pane and portion 60 is extended by an inturned leg 62 which abuts seal 46 and which is formed at its edge by a triangular rib 64, having a snap-engagement with a triangular rib 66 formed at the outward edge of abutment wall 37, said wall forming a cavity 68 in the portion 36. Retaining strip 56 is pressed in position by inward snapping movement for inter-engagement of the ribs 64 and 66.

It is noted that, with the door in closed position as shown in FIG. 2, the retaining strips cannot be removed, because of the obstruction formed by the adjacent panel to their outward extraction. On the other hand, it is easy to remove the retaining strips by simply sliding the same longitudinally of the outer section. The same is true for the seals 46. Thus, such seals can be removed for repair or replacement and, similarly, the sheathing pane 54 can be removed and replaced by simply pulling the strips 56.

Figure 1:
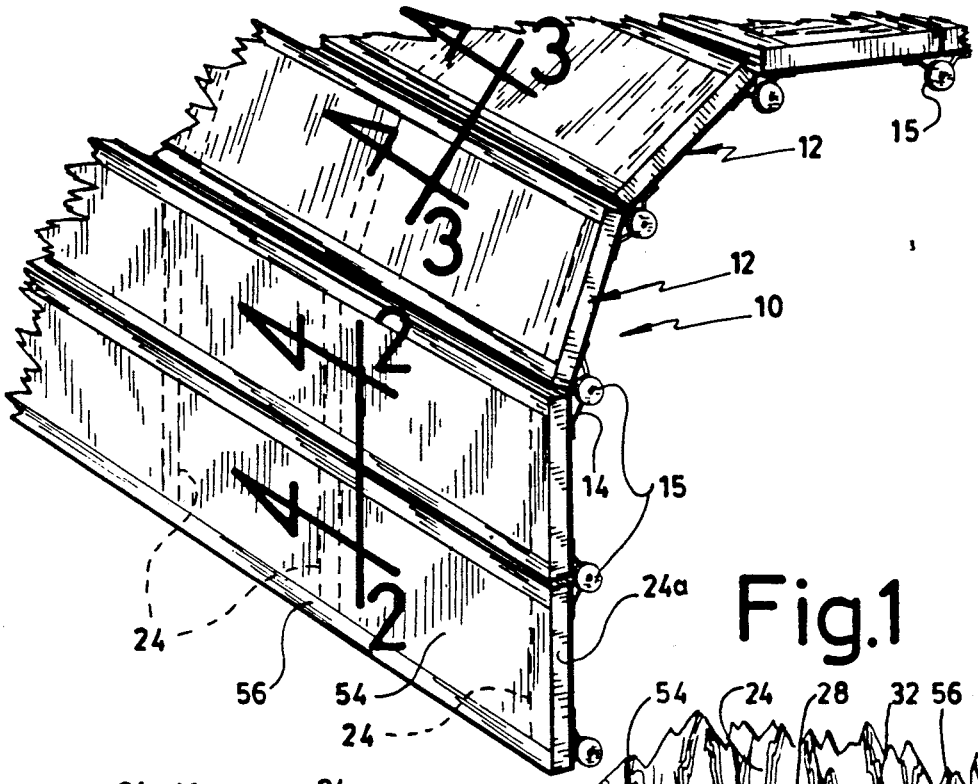
FIG. 1 is a partial, broken perspective view of a multiple panel garage door in half-way open position.

As shown in FIG. 1 and in FIGS. 12 to 15, and as previously noted, the casing 28 only extends along the top and bottom edges of the panels 12. Thus, the end edges of the sheating panes 54 and the end mullions 24*a* are exposed at the ends of the panels 12. However, the ends are not visible since they are covered by the weather-stripping on each side of the rails guiding the rollers 15 when the door is in closed position. Thus, cutting of extrusions 30, 32 at 45 degrees to form corners at the ends of the panels is not required. Moreover, it is noted that the ends of the mullions 24, 24*a* only extend to abut the inner face of the lateral portions 36 of the outer casing section 30 and, thus, they do not form any obstruction for the outer casing 30 which thus can extend from one end to the other of the panel 12. Only the inner casing section 32 needs to be cut and interrupted at the junction of each intermediate mullion 24 with the longitudinal frame member 20 and at the junction of the vertical shorter frame member 22 with the frame member 20.

It therefore appears that the assembly of the panel 12 is considerably facilitated.

Figure 5:
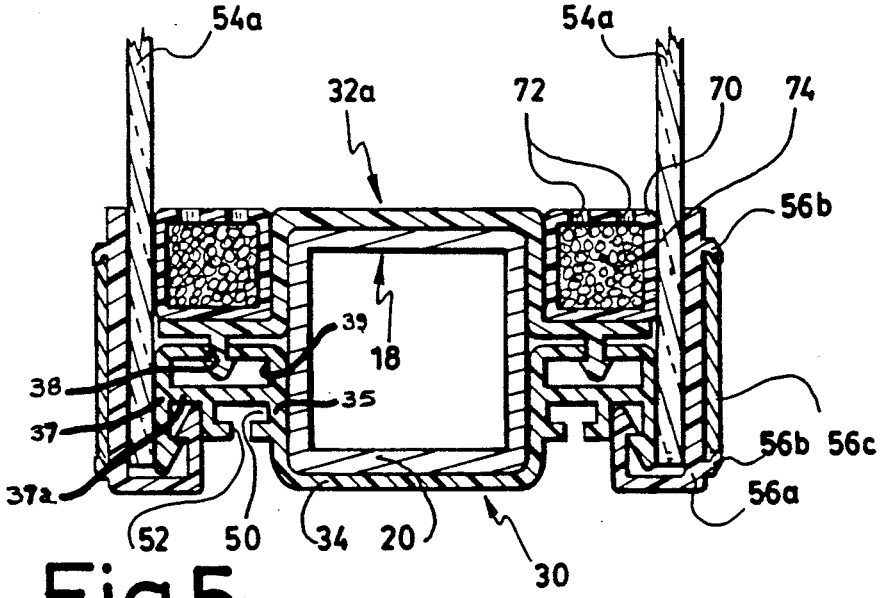
FIG. 5 is a partial cross-section of a second embodiment of the door panel.

It is possible to form a window in at least part of any selected panel 12. In this case, at least part of the sheathing panes 54, which are normally opaque to cover the insulating material 16, is replaced by transparent panes 54*a*, as shown in FIG. 5. These panes 54*a* are retained in the same manner by strips 56*a* similar to the retaining strips 56 and outer casing section 30. However, in order to remove any humidity which might form in the hollow space within the panel provided with the window, tubes 70 provided with perforations 72 and containing dessicant granules 74, are inserted by friction into lateral grooves formed by the modified inner casing section 32*a* in conjunction with the transparent sheathing panes 54*a*, as shown in FIG. 5. In FIG. 5, the outer casing section 30 remains as described in conjunction with the first embodiment of FIGS. 2 to 4. Retaining strips 56*a* are preferably formed with integral lips 56*b* which retain a decorative strip 56*c* which can be coloured differently of the door.

Figure 7:
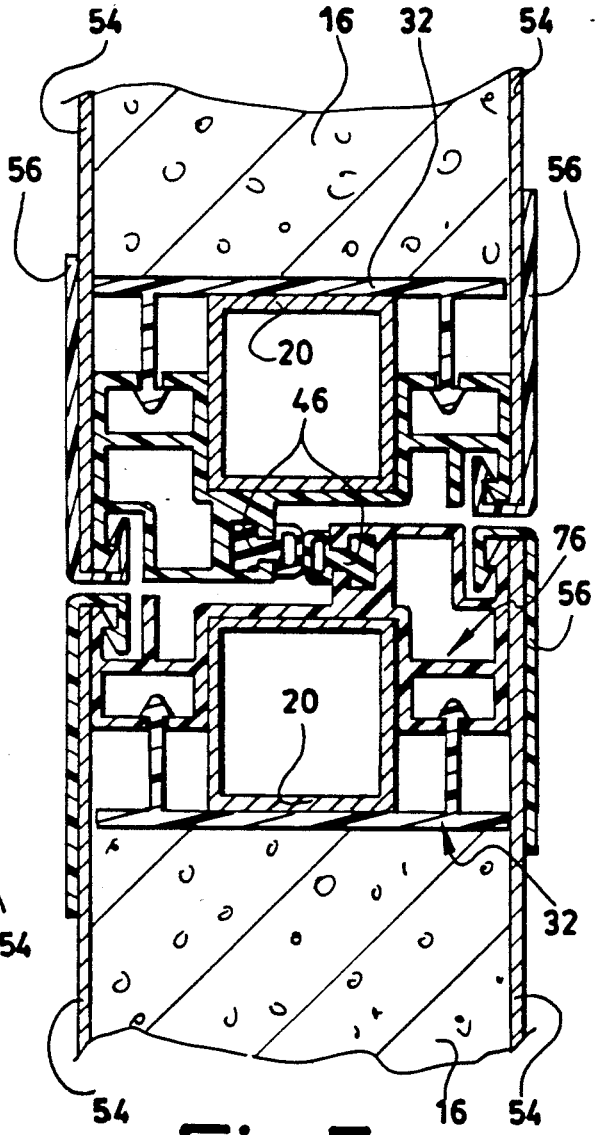
FIG. 7 is a cross-section of the junction of two door panels in accordance with the third embodiment.

FIGS. 6 and 7 show a modified embodiment in which the inner casing section 32 is as shown in the first embodiment of FIGS. 2 and 3, but in which the outer casing section is modified as shown as 76, so as to form a laterally-facing step 78 for retaining the seals 46 in a laterally-facing position. The outer casing section 76 at the top edge of a panel is inversely positioned with respect to the same casing section 76 at the lower edge of the panel. Thus, the two seals 46 laterally face in opposite directions and mutually engage each other, as shown in FIG. 7, when the adjacent door panels are co-planar. The manner of retaining the sheathing pane 54 by the retaining strips 56 and the manner of joining the two casing sections together, is the same as in the first embodiment.

Figure 8:
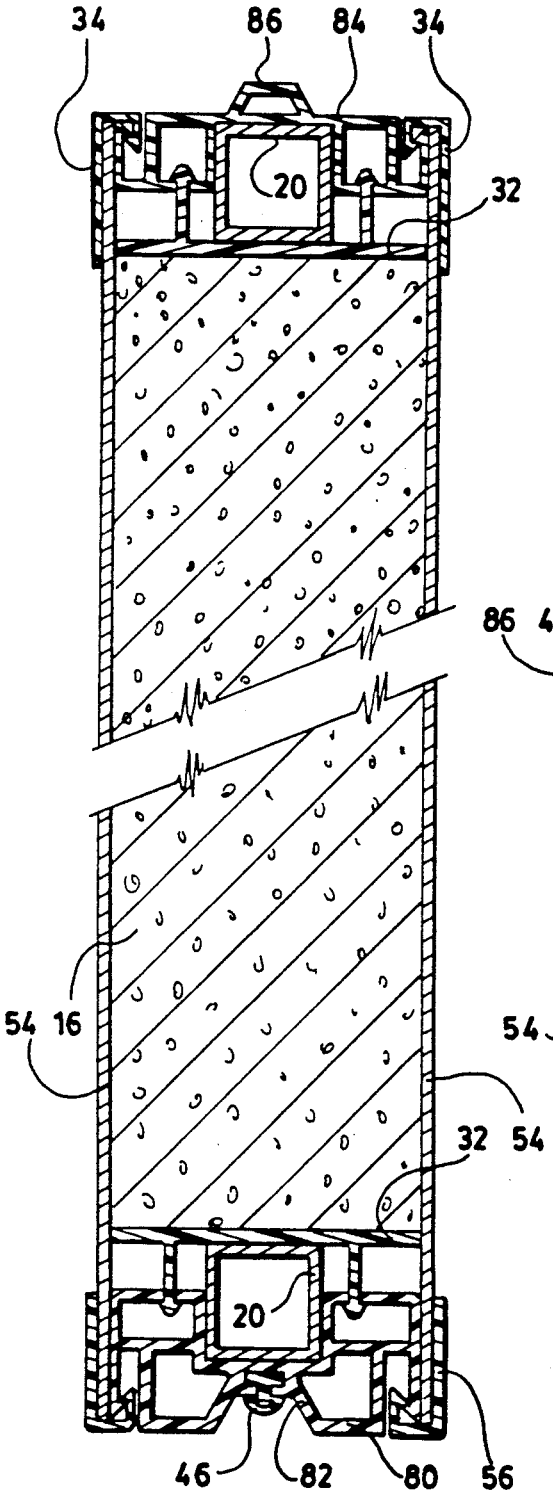
FIG. 8 is a cross-section of a door panel in accordance with a fourth embodiment.
Figure 9:
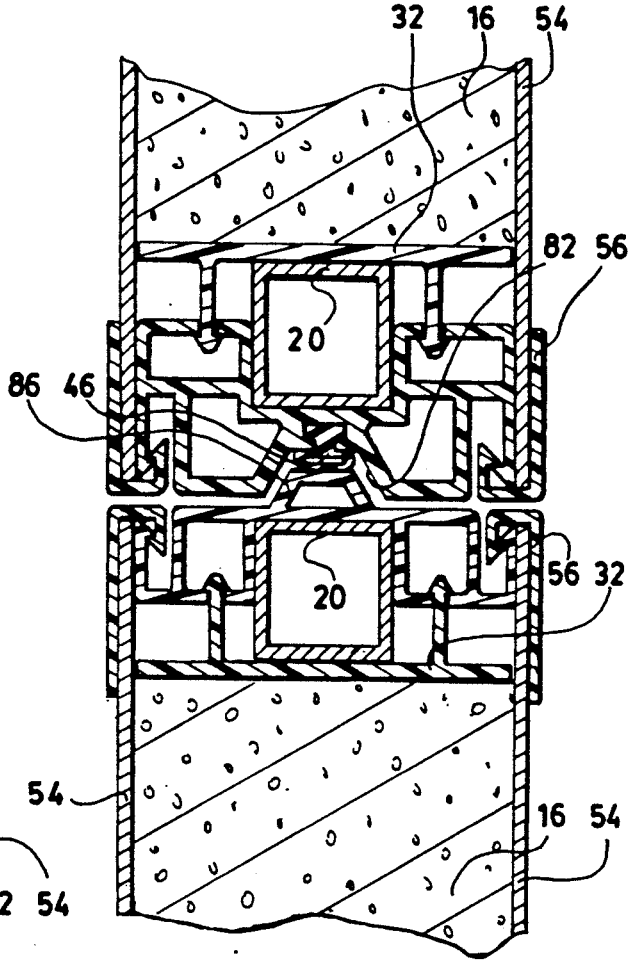
FIG. 9 is a cross-section of the junction of two door panels in accordance with the embodiment of FIG. 8.
Figure 11:
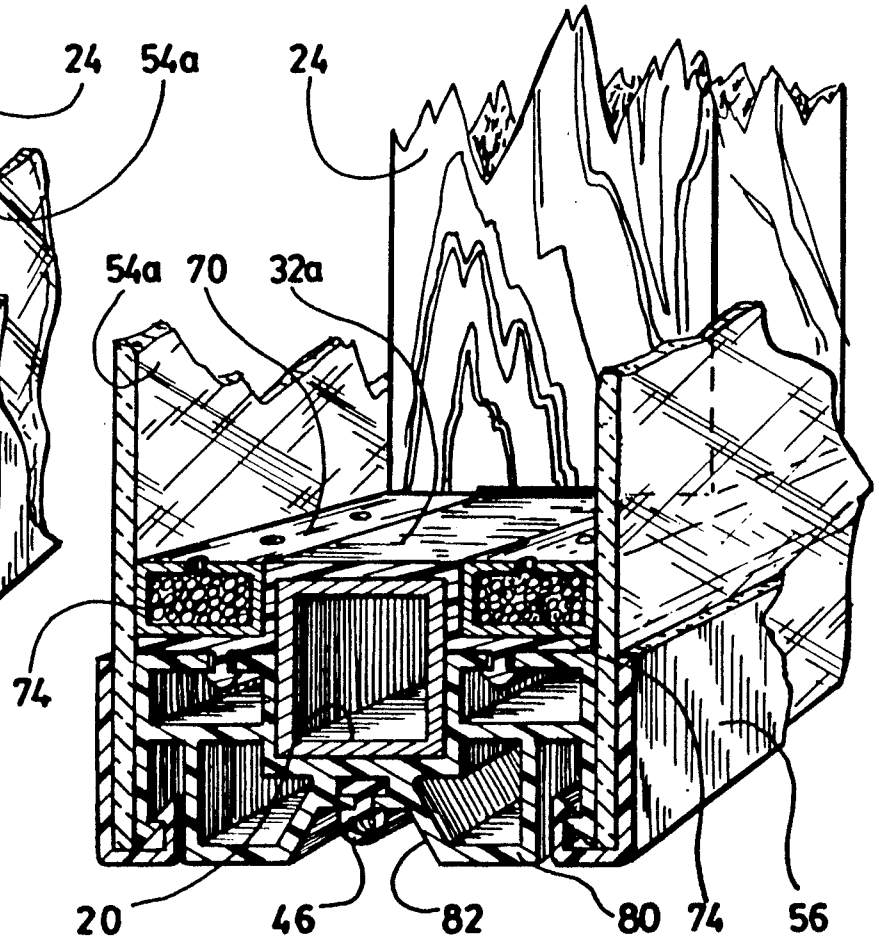

FIGS. 8 and 9 show still another embodiment in which the inner casing sections 32 and retaining strips 56 are as in the first embodiment, but in which the outer casing sections are modified. Outer casing section 80 is designed to carry a single sealing strip 46, centrally of the panel thickness-wise thereof, the seal 46 being disposed at the bottom of a V-shaped groove 82 formed by the outer casing section 80.

A different outer casing section 84 runs along the opposite longitudinal frame member 20 of the panel, said outer casing section 84 forming a centrally-disposed V-shaped rib 86 adapted to register with and press against the seal 46 of the adjacent panel 12 in the co-planar position of the two adjacent panels 12.

Figure 10:
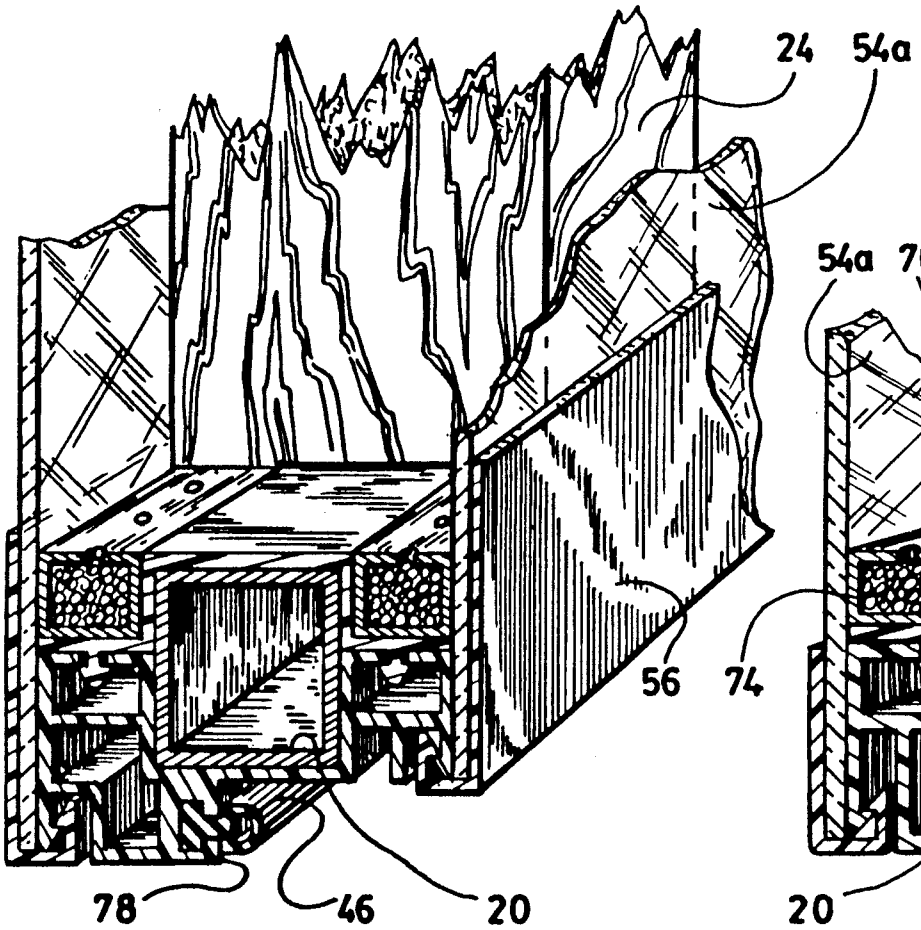
FIGS. 10 amd 11 are partial perspective views, also in cross-section, of the embodiments of FIGS. 6 and 8, respectively, but modified to retain dessicant tubes as in the embodiment of FIG. 5.
Figure 12:
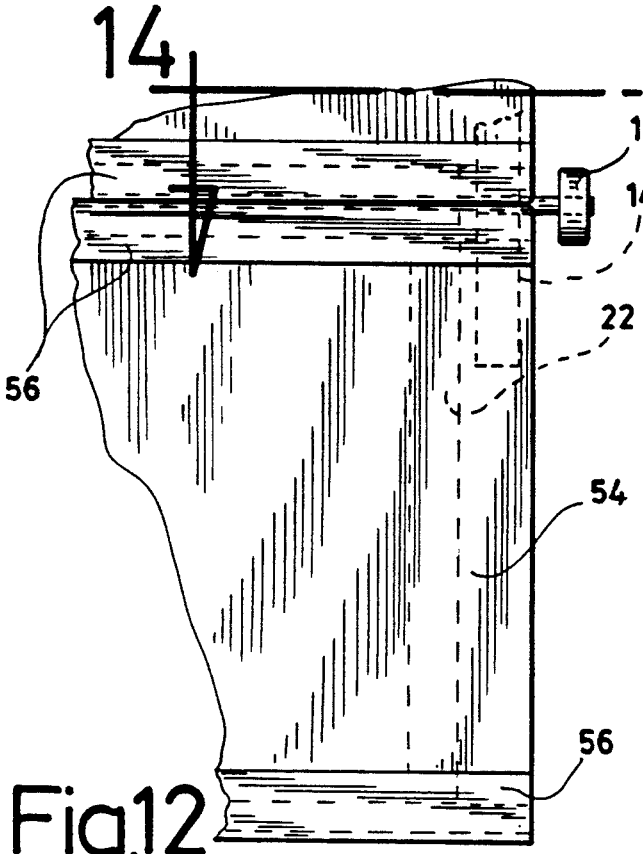
FIG. 12 is an elevation of the end portions of two adjacent panels.
Figure 13:
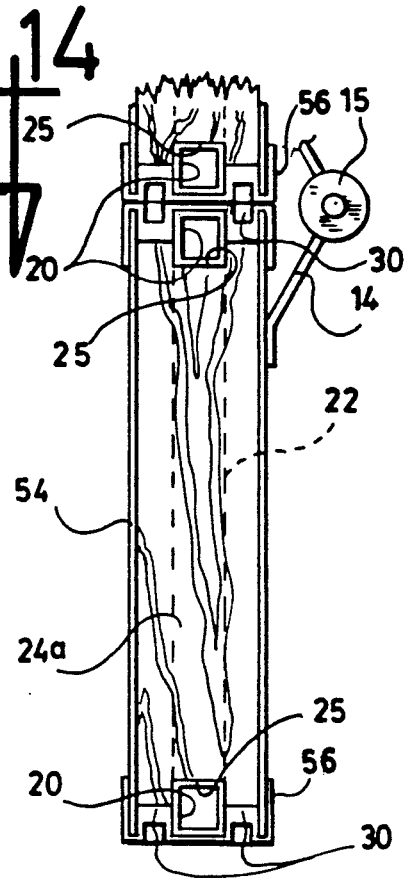
FIG. 13 is an edge view, taken along line 13—13 of FIG. 12.
Figure 15:
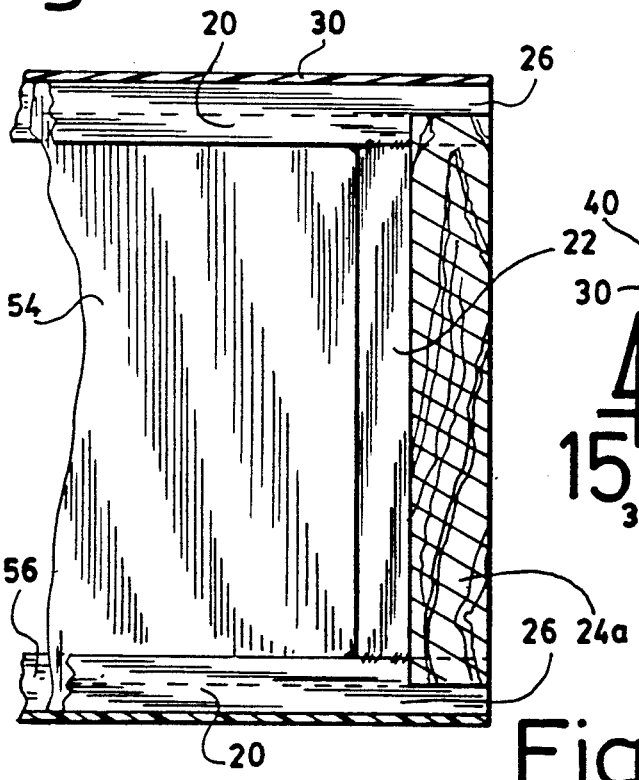
FIG. 15 is a vertical longitudinal section, taken along line 15—15 of FIG. 14.
Figure 14:
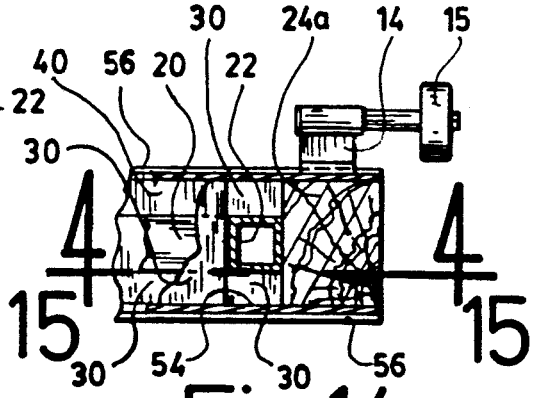
FIG. 14 is a partial plan section, taken along line 14—14 of FIG. 12.

FIGS. 10 and 12 show that transparent sheathing panes 54*a*, as in FIG. 5, can be provided with the embodiments of FIGS. 6 or 8. In either case, the inner casing section 32 is replaced by the inner casing section 32*a*, as in FIG. 5, and dessicant-containing tubes 70 are inserted in position as in FIG. 5 and for the same purpose.

Normally, the outer and inner casing sections 30, 32 are firmly retained around the longer frame members 20 by a simple press-fit. However, if necessary, glue may be additionally used to secure the two sections 30, 32 to the frame member 20. In this latter case, the inner casing section 32 could be dispensed with, except in the areas where transparent walls are formed, in order to conceal the frame members.

I claim:

1. A garage door panel comprising a rectangular reinforcing frame including a pair of longer members and a pair of shorter members, which are rigidly interconnected and which circumscribe a space, each longer member having side faces, an outer face and an inner face facing away from and toward said space, respectively, an outer casing section overlying said outer face and said side faces, an inner casing section overlying said inner face, and interconnector means interconnecting said inner and outer casing sections laterally of each side face, said outer casing section defining opposite abutment faces generally parallel to and laterally outwarldy spaced from said side faces, sheathing panes applied against said abutment faces and closing said space, retainer strips overlying said panes, surrounding the edges of the latter and secured to said outer section, said retainer strips retaining said panes against said abutment faces, mullions extending between said longer members and spaced from each other longitudinally of said frame, said mullions abutting against the inside faces of said panes and serving as screw anchors for door panel hinges screwed to said mullions by screws extending through said panes, said mullions having end notches receiving said longer members, said mullions terminating short of said outer sections, so that said outer sections are not obstructed by and overly the ends of said mullions, said inner section interrupted at the junctions of said mullions with said longer members, and seals carried by said outer casing section for contacting an adjacent garage door panel.

2. A garage door panel as defined in claim 1, wherein said sheathing panes are opaque and further including insulating material filling said space.

3. A garage door panel as defined in claim 1, wherein said longer members have end portions which protrude outwardly from said shorter members and two of said mullions extend along and on the outside of said shorter members, with their end notches receiving said end portions of said longer members.

4. A garage door panel as defined in claim 1, wherein at least a portion of said panes is transparent to define a window in said door panel.

5. A garage door panel as defined in claim 1, wherein said outer section forms two longitudinal cavities, each with a slit, located on both sides of said longer frame member, there being two seals each extending alongside and secured in said cavity.

6. A garage door panel as defined in claim 1, wherein one of said outer sections forms a centrally located longitudinal cavity and including one seal extending alongside and secured to said cavity while the other one of said outer casing sections forms a centrally-located rib adapted to contact and compress the seal of an adjacent garage door panel.

7. A garage door panel as defined in claim 1, wherein said inner frame section forms grooves on each side of said longer frame member and further including dessicant containing tubes inserted within said grooves and having perforations opening into said space.

8. A garage door panel comprising a rectangular reinforcing frame including a pair of longer members and a pair of shorter members which are rigidly interconnected and which circumscribe a space, each longer member having side faces and an outer face and an inner face facing away from and toward said space, respectively, an outer casing section overlying said outer face and said side faces, an inner casing section overlying said inner face and said side faces and interconnector means interconnecting said inner and outer casing sections, said outer casing section defining opposite abutment faces generally parallel to and laterally outwardly spaced from said side faces, sheathing panes applied against said abutment faces and closing said space, retainer strips overlying said panes, surrounding the edges of said latter and secured to said outer sections, said retainer strip retaining said panes against said abutment faces, and seals carried by said outer casing sections for contacting an adjacent door panel, wherein said inner and outer casing sections are extruded members made of a synthetic resin and said interconnector means includes male and female snapping members.

9. A garage door panel as defined in claim 8, wherein each retainer strip is of J-shaped cross-section having a shorter leg formed with a snapping rib.

10. A garage door panel as defined in claim 9, wherein said retainer strip has a longer leg with an outer face, and further including longitudinally extending, spaced, parallel, integral lips protruding from said outer face of said retainer strip for retaining a decorative strip against said outer face.

11. In a sectional type door including a plurality of adjacent rectangular hingedly-connected door panels, each door panel including a rectangular reinforcing frame formed of a pair of longer members and of a pair of shorter members, which are rigidly interconnected and which circumscribe a space, each member of quadrangular cross-section having side faces, and an outer face, and an inner face facing away from and towards said space, respectively, two assemblies of an extruded outer casing section and of an extruded complementary inner casing section, each assembly complementarily surrounding one of the longer members, said outer casing sections of U-shaped cross-section defining a web and tubular side legs overlying and contacting said outer and said side faces, respectively, of said longer members along the entire length of each longer member, said inner casing sections overlying and contacting said inner face of said longer members along the length of the latter, each tubular leg including an inner wall perpendicular to said web and an abutment wall parallel to and equally outwardly spaced from said inner wall, and connector walls interconnecting said abutment wall with the respective inner walls, said connector walls generally parallel to said web of said outer casing section and disposed on both sides of said reinforcing frame, sheathing panes overlapping the abutment walls of both outer casing sections and closing said space, retaining strips of generally J-shaped cross-section, having a main portion generally parallel to and overlapping the outside of said sheathing panes and retaining the latter, said retaining strips having a transverse portion extending across said abutment wall and substantially parallel to said web, said retainer strips further having a connector portion extending on the inside of said abutment wall, said outer casing portion including complementary connector portions located between each inner wall and the associated abutment wall releasably connected with the connector portions of the retaining strips.

12. In a sectional type door as defined in claim 11, further including mullions extending between said longer members and spaced from each other longitudinally of said frame, said mullions abutting against the inside faces of said sheathing panes and serving as screw anchors for door panel hinges screwed to said mullions by screws extended through said sheathing panes, said mullions having end notches receiving said longer members, said mullions terminating short of said outer sections, so that said outer sections are not obstructed by and overly the ends of said mullions, said inner sections interrupted at the junctions of said mullions with said longer members.

13. In a sectional type door as defined in claim 12, wherein said outer section forms two longitudinal cavities, each located between said inner wall and said abutment wall and on the outside of said connector wall, each cavity opening to the exterior through a slit of a slitted wall, inwardly offset relative to said web and generally parallel thereto, and further including two seals in the form of an elongated extruded strip extending along said slitted wall on the outside thereof and secured within said cavities.

14. A garage door panel comprising a rectangular reinforcing frame including a pair of longer members and a pair of shorter members, which are rigidly interconnected and which circumscribe a space, each longer member having side faces and an outer face and an inner face facing away from and toward said space, respectively, an outer casing section overlying said outer face and said side faces, an inner casing section overlying said inner face, interconnector means releasably connecting said inner and outer casing sections outwardly of each side face, said outer casing section defining opposite abutment faces generally parallel to and laterally outwardly spaced from said side faces;

sheathing panes applied against said abutment faces, retainer strips overlying said panes, surrounding the edges of the latter and secured to said outer casing section, said retainer strips retaining said panes against said abutment faces, and seals carried by said outer casing section for contacting an adjacent garage door panel, wherein said seal is an extruded strip, of flexible material, of uniform cross-section, defining a tubular body and an anchoring root formed of a main leg, centrally joined to said tubular body, and of a free transverse leg, said outer casing section defining a longitudinal cavity with a longitudinal slit, said cavity receiving said seal strip transverse leg with said seal strip main leg extending through said slit; wherein said cavity and its slit define a slitted wall, said slitted wall disposed in a plane generally parallel to said sheathing panes, the seal associated with one longer frame member being directed transversely of said panel in a direction away from the seal associated with the other one of said longer frame members.

* * * * *